US009186708B2

(12) United States Patent
Meissner

(10) Patent No.: US 9,186,708 B2
(45) Date of Patent: Nov. 17, 2015

(54) INDUSTRIAL CLEANING SYSTEM

(76) Inventor: Golo Meissner, Marienheide (DE)

( * ) Notice: Subject to any disclaimer, the term of this patent is extended or adjusted under 35 U.S.C. 154(b) by 174 days.

(21) Appl. No.: 13/988,129

(22) PCT Filed: Nov. 17, 2011

(86) PCT No.: PCT/DE2011/075277

§ 371 (c)(1),
(2), (4) Date: May 17, 2013

(87) PCT Pub. No.: WO2012/065607

PCT Pub. Date: May 24, 2012

(65) Prior Publication Data

US 2013/0233359 A1 Sep. 12, 2013

(30) Foreign Application Priority Data

Nov. 17, 2010 (DE) ..... 10 2010 051 686
Sep. 7, 2011 (DE) ..... 10 2011 112 692

(51) Int. Cl.
*B08B 3/02* (2006.01)
*B08B 3/04* (2006.01)
*B08B 15/02* (2006.01)

(52) U.S. Cl.
CPC ... *B08B 3/02* (2013.01); *B08B 3/04* (2013.01); *B08B 15/02* (2013.01)

(58) Field of Classification Search
CPC ..... B08B 13/00; B08B 3/02; B08B 3/04; B24C 9/00; B25J 11/00; B05B 15/1214; B05B 15/02
See application file for complete search history.

(56) References Cited

U.S. PATENT DOCUMENTS

| | | | | | |
|---|---|---|---|---|---|
| 3,603,037 | A * | 9/1971 | Mann et al. | ..... | 451/2 |
| 5,062,758 | A * | 11/1991 | Trillwood | ..... | 414/217 |
| 5,105,932 | A * | 4/1992 | Bryson et al. | ..... | 198/619 |
| 5,148,714 | A * | 9/1992 | McDiarmid | ..... | 74/89.4 |
| 5,261,715 | A * | 11/1993 | Blatt et al. | ..... | 269/71 |
| 6,958,007 | B2 * | 10/2005 | Dangel | ..... | 451/89 |
| 2008/0006306 | A1 * | 1/2008 | Leyendecker et al. | ..... | 134/61 |

FOREIGN PATENT DOCUMENTS

| | | | |
|---|---|---|---|
| DE | 4125891 | A1 | 2/1993 |
| DE | 19703310 | C1 | 4/1998 |

(Continued)

OTHER PUBLICATIONS

English translation of Office Action dated Jun. 30, 2015, from Japanese Patent Office in corresponding Japanese Patent Application No. 2013-539139.

*Primary Examiner* — Michael Barr
*Assistant Examiner* — Tinsae Ayalew
(74) *Attorney, Agent, or Firm* — Kriegsman & Kriegsman

(57) ABSTRACT

Industrial cleaning plant having at least one cleaning chamber and a transport device that can be driven, rotated or pivoted. The transport device has a lifting device with a gripping tool for the items to be cleaned, with which a transport lift is produced into the chamber. The chamber can be closed with a cover, which forms one unit with a lifting arm of the lifting device. The cover is held moveably in a guide in an aperture along the shaft of the lifting arm. In closed position of the cover, an up-or-down movement of the gripping tool in the cleaning chamber can be controlled with the lifting arm which also has an entrainment mechanism forming a stop for the cover in upward movement of the lifting arm for opening the chamber.

21 Claims, 10 Drawing Sheets

(56) References Cited

FOREIGN PATENT DOCUMENTS

Figure 1:
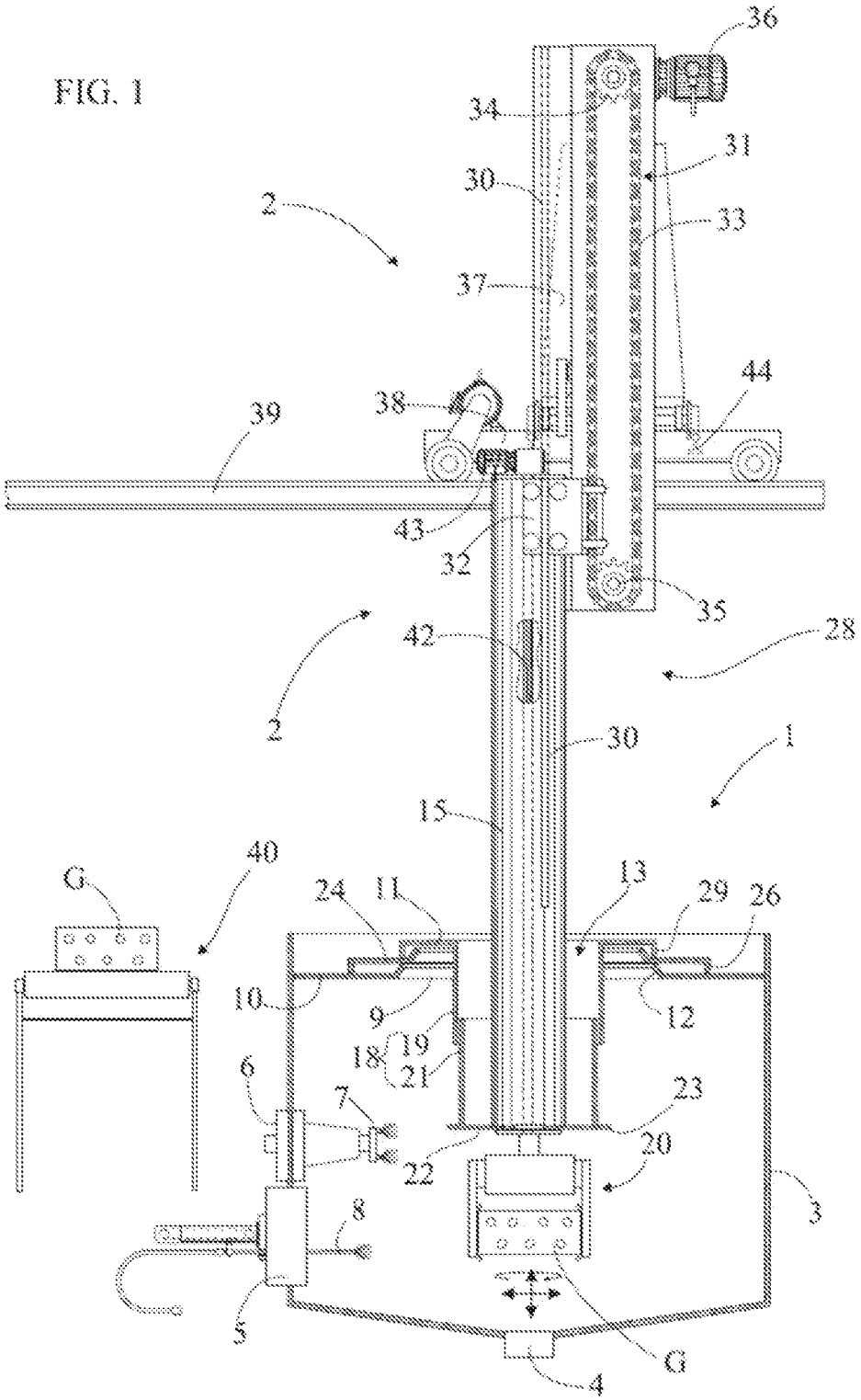

| | | | |
|---|---|---|---|
| DE | 102005031515 | A1 | 1/2007 |
| DE | 102006026171 | A1 | 12/2007 |
| EP | 1378326 | A1 | 1/2004 |
| EP | 2072154 | A2 | 6/2009 |
| JP | S5116464 | U | 2/1976 |
| JP | S58127396 | U | 8/1983 |
| JP | S5965792 | U | 5/1984 |
| JP | H06126263 | A | 5/1994 |
| JP | H08340077 | A | 12/1996 |
| JP | H0919663 | A | 1/1997 |
| JP | 2001170576 | A | 6/2001 |
| JP | 2001232320 | A | 8/2001 |
| JP | 2010188286 | A | 9/2010 |

* cited by examiner

INDUSTRIAL CLEANING SYSTEM

The invention relates to an industrial cleaning plant having one or more cleaning chambers for the treatment of items to be cleaned, and a transport device that can be driven, rotated or pivoted for loading or unloading, the transport device having a lifting device with a gripping tool for the items to be cleaned, and the lifting device with the gripping tool is guided through openings to the cleaning chambers that can be closed by a cover.

Through DE 10 2006 026 171 A1, an apparatus is known for the partial irradiation of items to be cleaned, this apparatus being a component of a cleaning plant with which workpieces are washed, rinsed or dried. The apparatus for irradiation is composed of several irradiation chambers with a projecting beam tube, these chambers being disposed around a base. The irradiation chambers have a hood, which is mounted by means of a guide that can be moved horizontally in the direction of the base. Relative to the hoods, the base is installed in stationary manner and has covers corresponding to the number of hoods for tight sealing in the operating position. For loading, the hood is separated from the cover and placed at a distance from the cover. A gripping tool acting like a claw projects out from the base from the plane of the cover. The gripping tool is mounted in a rotatable manner and can be pivoted on the base by means of a drive mechanism, so that the workpiece can be aligned relative to the beam tube for the purpose of irradiating several sides.

In the known apparatus, hoods and covers are assigned to one another in pairs, so that each hood can be closed with a separate cover in order to avoid losses of cleaning agent in the case of a horizontal construction. There is no possibility, however, in addition to the rotating movement of the gripping tool, to also conduct an up-and-down or a back-and-forth movement in the irradiation chamber. Variability in the movement of the gripping tool is limited in the case of the known apparatus. Due to these limitations, the treatment of the items to be cleaned is not optimal on all peripheral sides, so that treatment time is prolonged.

Through DE 197 03 310 C1, a cleaning plant is known that has two cleaning chambers that can be moved in a circle, these chambers having receptacles for the items to be cleaned, and a stationary cover device with rigidly installed treatment fixtures located above the movement path. In the operating position, the cover device is lowered onto a cleaning chamber found in position and seals the cleaning chamber. In this known plant, the cover device can be moved with a lifting device from an open position into a closed position. In principle, the plant is not designed for an up-and-down movement of the lifting device during treatment.

Through DE 41 25 891 C2, an apparatus is known for cleaning soiled parts with a cleaning chamber that can be hermetically sealed. The cleaning chamber has a receptacle for items to be washed, which is suspended on a cover that in turn hangs on a lifting device that can be driven on a rail between a working position and a loading station. For loading in the loading station, the cover with the items to be washed is raised and moved into the loading position and lowered into the cleaning chamber until the cover lies on the walls of the cleaning chamber and seals it. The items to be washed can be rotated or pivoted back and forth during the washing process by means of a motor. The known apparatus has only one cleaning chamber and the lifting device cannot be activated during treatment, since it if were, the cover would open and the treatment medium would be lost. Further, an adjustment of the items to be cleaned inside the cleaning chamber is not possible with the lifting device. The rotation or back-and-forth movement of the items to be cleaned takes place conventionally by means of a separate drive and not with the lifting device.

The object of the invention is to achieve an improvement of the cleaning plant by sealing the cleaning chamber by means of a cover device that is adapted to the direction of movement of the lifting device. The object is achieved according to the invention in a first embodiment by measures described in claim 1 and according to a second embodiment by measures described in claim 2. Enhancements of the invention are described in the subclaims.

The advantage of the invention consists of the fact that the cover remains on the lifting arm of the lifting device when the items to be cleaned are transported out of the cleaning chamber to the shelf, or in the case of a multi-chamber plant, from one cleaning chamber to the next. Due to the fact that lifting arm and cover form one structural unit, the cover is entrained in the transport of the items to be cleaned with the transport device. The particular feature therein is that the lifting arm takes up the cover in a central aperture and the cover is guided in moveable manner in longitudinal direction on the lifting arm, so that a lifting movement of the items to be cleaned is possible in the closed cleaning chamber. The lifting arm has an entrainment mechanism for the cover, so that entrainment occurs by raising the lifting arm from a defined lifting height. Likewise, by lowering the lifting arm, e.g., for loading the cleaning chamber, from a defined lower level of the lifting arm, there is a contact connection of the cover with a support on the opening of the cleaning chamber. By means of this design, the cleaning chamber also always remains closed with an up-and-down movement of the items to be cleaned in the cleaning chamber by raising and lowering the lifting arm during treatment. Further, the cleaning chamber is automatically opened by raising the lifting arm for the purpose of unloading the items to be cleaned. In this way, the entrainment mechanism of the lifting arm comes into contact connection with the cover. Another advantage of the invention consists of the fact that the items to be cleaned can be adjusted in the cleaning chamber when the cover is closed, by being able to adjust the lifting arm in height relative to the cleaning chamber. In this way, items to be cleaned of different size can be positioned exactly at emitting units of the cleaning chamber.

A variation that makes it possible to position the gripping tool in a simple way by means of a horizontal and a vertical movement makes possible a further improvement of the invention.

The gripping tool can be exactly aligned relative to the fixtures in the cleaning chamber by which treatment medium is sprinkled, sprayed or emitted onto the items to be cleaned. Further, an improvement in the treatment result can also be achieved during the treatment by back-and-forth movement or up-and-down movement of the items to be cleaned, since the items to be cleaned can be guided along nozzle assemblies, for example, in order to intensively treat critical regions at the periphery of the items to be cleaned. In the closed position of the cover, the lifting arm can conduct a vertical up-and-down movement and a horizontal back-and-forth movement. In this way, the cover can be moved and guided to a support, preferably on the front wall of the cleaning chamber, and can be moved by horizontal movement of the lifting arm within specific limits.

The lifting arm of the lifting device is advantageously designed as a column disposed vertically in guides and can be moved with a chain drive. The drive chain is guided between two pinions, wherein one pinion is driven by a motor. The chain drive is attached to a console, which is mounted on a trolley. The trolley moves on guide rails and can transport the lifting arm of the lifting device from a position above the shelf for the items to be cleaned to a position above the cleaning chamber. Further, a vertical movement of up-and down can be carried out in the cleaning chamber with the lifting arm. With the gripping tool, the items to be cleaned can be received by a shelf and can be raised and lowered into the cleaning chamber. In the operating position of the lifting arm within the cleaning chamber, a back-and-forth movement can also be conducted with the transport device, so that the items to be cleaned can be guided along to any desired place at the sprinkling, spraying or emitting nozzles during the treatment. The cover also makes these movements and closes the opening. The lifting arm of the lifting device can also be controlled up and down in the vertical direction inside the cleaning chamber and during the treatment, so that all places of the items to be washed can be reached on one side. Advantageously, the lifting arm with the gripping tool can be mounted in a rotatable manner around its longitudinal axis, so that by rotating the gripping tool, cleaning can be conducted on all peripheral sides. Advantageously, a continuous drive shaft for the gripping tool, which is driven by a motor accommodated at the other end of the lifting arm, is mounted in the lifting arm.

In order to increase the flexibility of the transport device, guide rails are laid along a series of cleaning chambers up to the shelf on which a trolley with a lifting device conducts transport. The lifting device has a lifting arm with a gripping tool, so that soiled items that are to be washed can be removed from the shelf and can be introduced into a first cleaning chamber, in which a first treatment process, for example a washing process, takes place, up to a last cleaning chamber, in which, for example a drying process takes place, and from there, the cleaned items are brought to the shelf for outward transport. Advantageously, rails are introduced on the trolley crosswise to the running direction, on which a carriage is guided. The carriage can bear the lifting device, and the lifting arm with the gripping tool can be moved thereby independently of the running direction of the trolley. Due to this arrangement, irregularly disposed cleaning chambers distanced from the shelf can also be operated in a 3-coordinate system. In the simplest case, cleaning chambers disposed in a series and at a distance from a shelf found removed from the cleaning chambers, as the origin, can be loaded with items to be washed from a conveyor belt, for example, whereby the gripping tool takes up the items to be cleaned and the lifting arm raises the items to be washed in a plane above the level of the cleaning chambers, the trolley controls a first cleaning chamber with an X coordinate, and the carriage transports the lifting arm with items to be cleaned along a Y coordinate into a position above the opening of the cleaning chamber. The lifting arm finally lowers the gripping tool with the items to be cleaned through the opening and holds it during the treatment, whereby in this position, the carriage, trolley and lifting arm execute movements, also washing movements, coordinated relative to one another.

In the embodiment according to claim 2, the transport device has a multi-membered manipulator arm controllable about axes and a lifting arm with a gripping tool. In a central aperture, the cover is guided in moveable manner along the shaft of the lifting arm, and there is a connection between cover and lifting arm via a pendulum or self-aligning bearing. The self-aligning bearing advantageously involves a ball-and-socket joint that additionally possesses an axial guide for uptake of the lifting arm. The ball-and-socket joint is advantageously designed with a ball head on the lifting arm and a ball socket on the cover in the region of the central aperture. The ball socket advantageously encloses the ball head over its diameter, so that a simple connection results. Further, a seal can be produced via the cover by means of this design. An entrainment mechanism for the cover is provided at the end of the lifting arm, whereby, for purposes of entraining the cover in the upward movement of the lifting arm, the entrainment mechanism forms a stop for the cover. For closing the cleaning chamber in downward movement of the lifting arm, the cover is placed on the cleaning chamber. With a closed cleaning chamber, a translatory movement of the lifting arm can occur in the guide or a self-aligning movement of the lifting arm can occur in the self-aligning bearing with the manipulator arm.

According to an advantageous enhancement of the invention, the self-aligning bearing is equipped with a lengthwise guide unit inserted with a gap into the central aperture of the cover. In the sense of the invention, the movability of the guide unit in the central aperture of the cover relative to the cover when the cover is closed, is defined as the self-aligning bearing. The guide unit is rigidly joined to the shaft of the lifting arm and the cover is held movably on the guide unit. The gap between the guide unit and the aperture of the cover serves as a guide for the lifting arm and makes possible a movement of the lifting arm independently from the cover, in the operating position, by movements of the manipulator arm; also made possible are an up-and-down movement of the guide unit or the shaft with the gripping tool and a self-aligning movement by tilting the lifting arm.

The guide unit can be designed in the region between gripping tool and manipulator arm around the lifting arm as a concentric cage or as a cylindrical unit, such as a tube segment with a round or square cross section. In the operating position, in order to prevent cleaning fluid from reaching the outside through the guide unit, the inner cross section of the guide unit is sealed opposite the shaft of the lifting arm. Further, the gap between the guide unit and the aperture of the cover is covered by a flexible sealing unit, such as a sheath or sleeve, which produces a connection between cover and guide unit and forms one structural unit with the lifting arm. The sheath or the sleeve is attached to the cover on one side and to the guide unit on the other side. The sheath or the sleeve can be designed as a bellows that is compressed or expands corresponding to the lifting motion of the guide unit. The sealing unit is composed of a liquid-tight material. The sealing unit can additionally fulfill the function of a holder for the cover if the cover should remain connected to the guide unit during the transport lift. Alternatively, the function of the holder can be assumed by carrying straps, which are attached to the cover on one side and to the guide unit on the other side. In this case, the sealing unit is relieved of the weight of the cover.

The advantage of these embodiments is that the treatment of the items to be cleaned in the cleaning chamber is improved. In addition to an up-and-down movement of the gripping tool with the lifting arm, the gripping tool can still execute a self-aligning movement in any direction by control of the manipulator arm in the cleaning chamber. The control of the manipulator arm advantageously can be executed by an industrial robot, which can conduct an autonomous, flexible operating routine by way of complex programming, so that items to be cleaned can be optimally treated in the cleaning chamber. There are controllable functions that make possible an individual handling and alignment of the items to be cleaned relative to the treatment fixtures installed in the treatment chamber.

For several cleaning chambers, only one cover fitting all cleaning chambers is necessary, this cover automatically closing the opening of the cleaning chamber upon each immersion into a cleaning chamber. Further, the cleaning chamber also then remains closed when the items to be cleaned are moved in the cleaning chamber.

According to an enhancement of the invention, in the closed position of the cover, there results a sliding, horizontal displacement capability of the cover produced at the opening of the cleaning chamber upon a horizontal movement of the lifting arm. The horizontal displacement capability of the cover simultaneously makes possible a sealing of the cover with the opening of the cleaning chamber, so that the cleaning chamber is tightly closed also with a back-and-forth movement of the cover.

The advantage is that sealing is produced both with a back-and-forth movement, an up-and-down movement or a self-aligning movement, so that a loss of treatment medium is prevented. Due to the fact there is sealing both in the horizontal as well as in the vertical direction of movement, a horizontally adjustable flap-like sliding cover is introduced around the lifting arm as a base component, which lies loosely on the edge of the opening of the cleaning chamber. On one side, the sliding cover has a concentric tube extension that is cylindrical, for example, and on the other side, the lifting arm also possesses a tube extension that is cylindrical, for example, at its end bearing the gripping tool, and that runs concentrically around the lifting arm. Both parts form a tight telescopic, sliding connection which assures the tightness of the lifting arm in the vertical direction. The degree of coverage of the sliding cover relative to the opening of the cleaning chamber is dimensioned so that coverage is still present at the end position in each sliding direction.

For improvement of the seal between a flap-like part that forms the sliding cover and the edge region of the opening of the cleaning chamber, a sealing web running around the outer periphery is introduced, this web being able to be supported by its front face on the surface in the edge region of the opening.

Another improvement of the seal is achieved by an intermediate cover, which, as described in the subclaims, lies with its encircling collar on the edge region of the opening and can be displaced horizontally, and is not entrained, but remains at the cleaning chamber when the lifting arm is pulled out of the cleaning chamber.

Two examples of embodiment of the invention will be explained below in more detail on the basis of the drawings.

Figure 2:
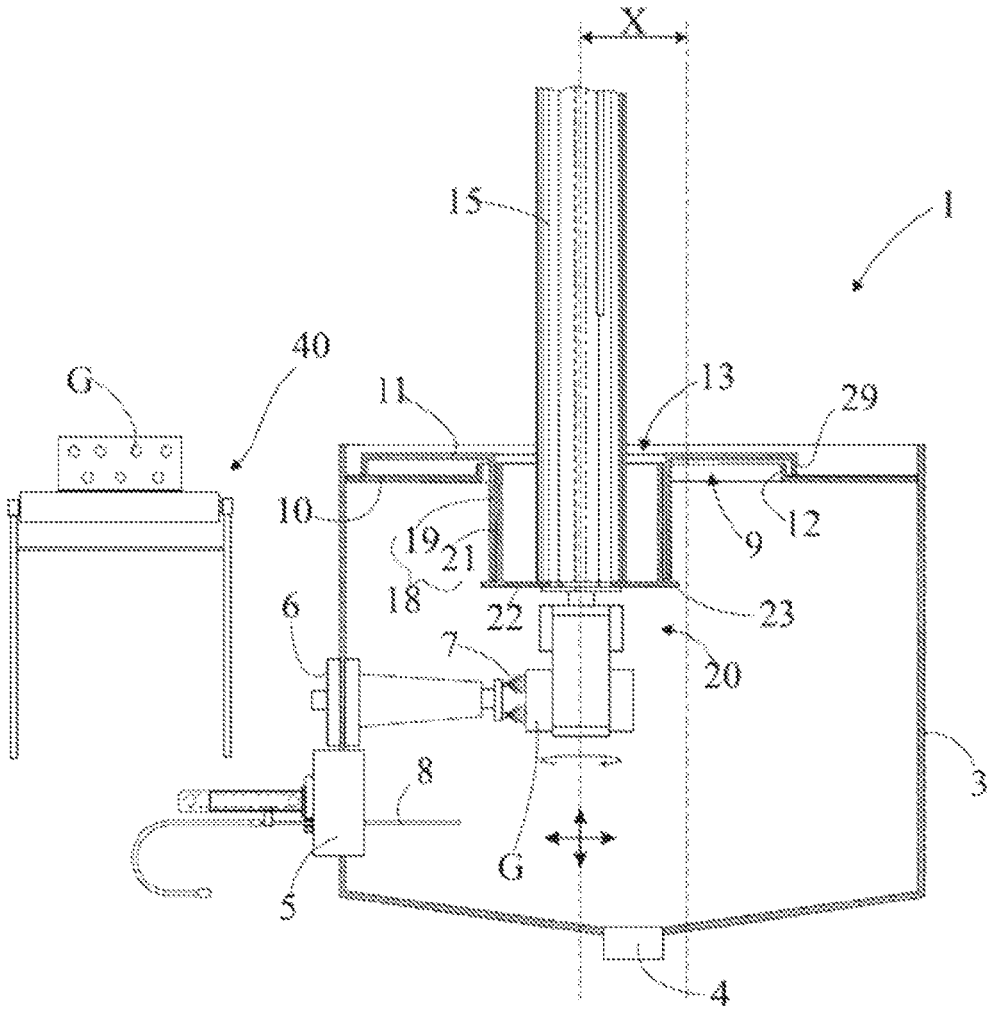
Figure 3:
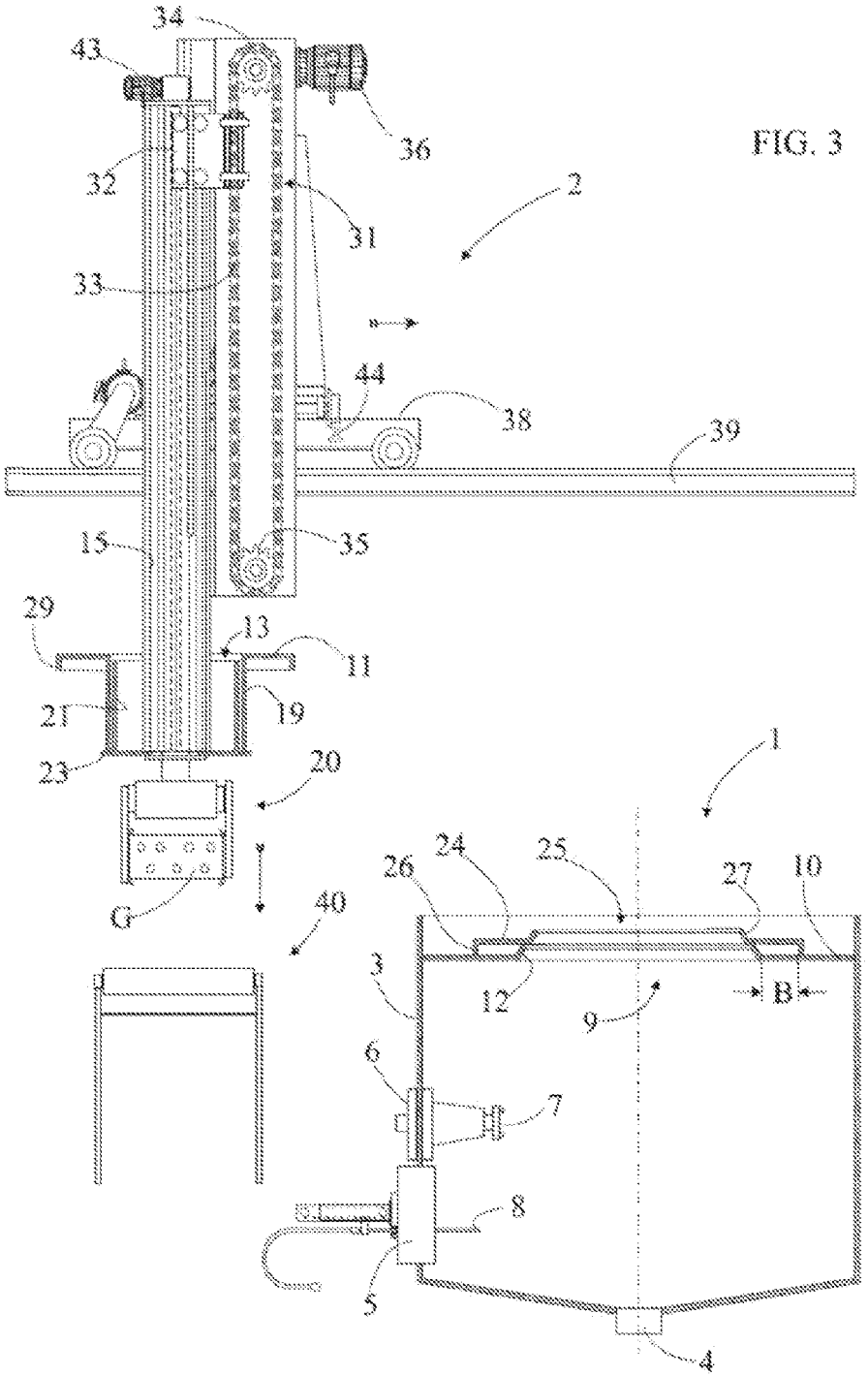
Figure 4:
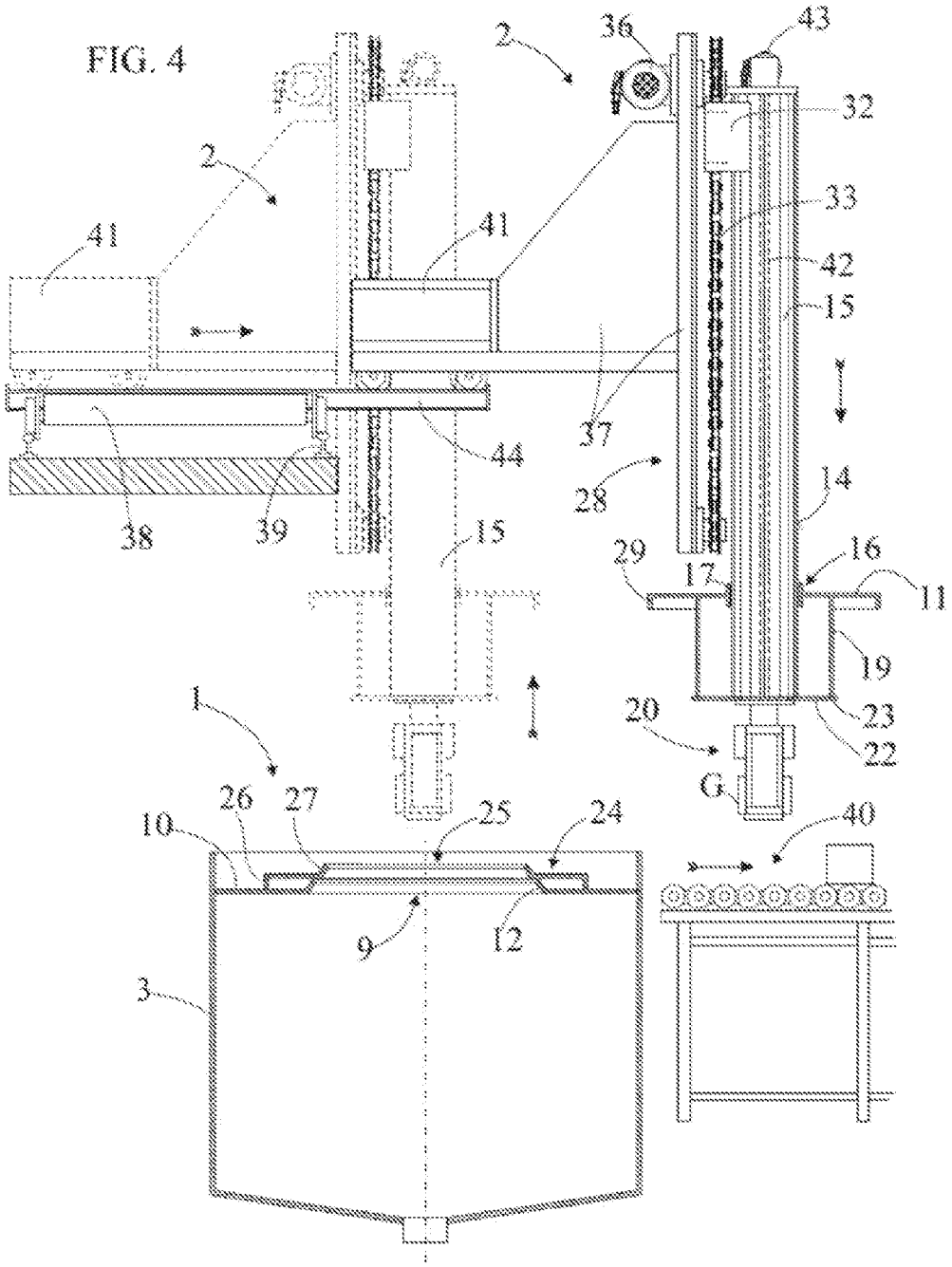
Figure 5:
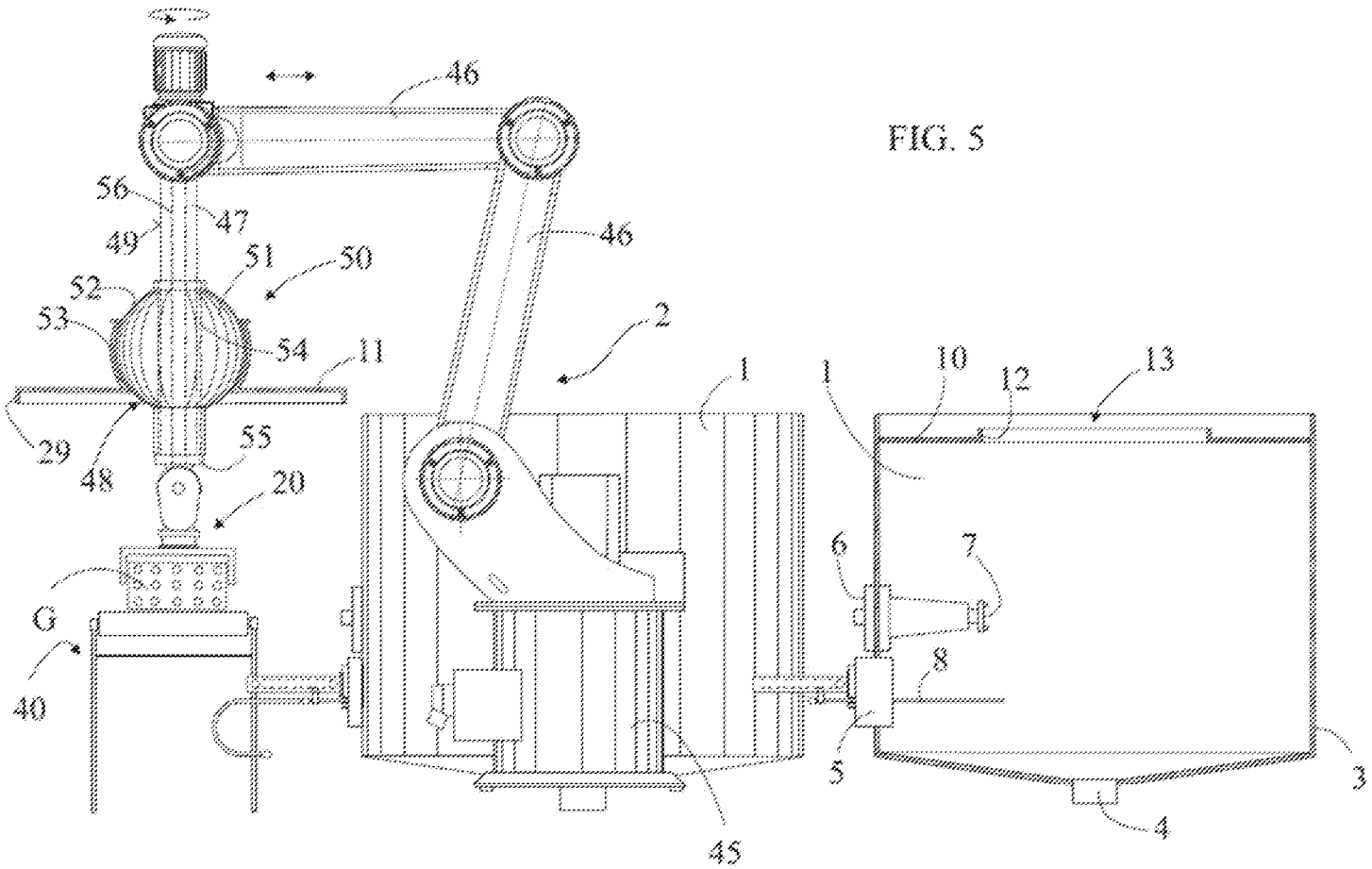
Figure 6:
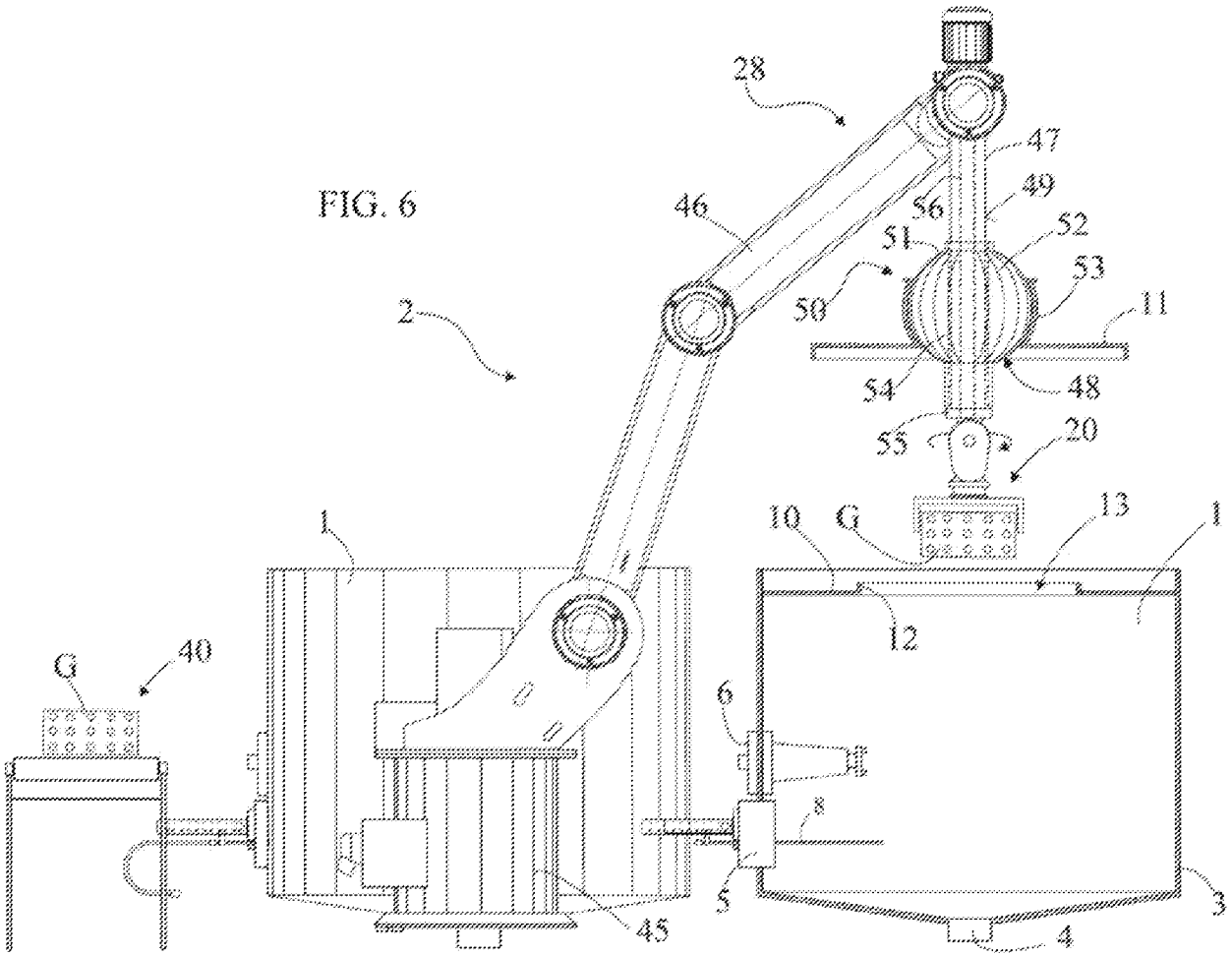

Herein:

FIG. 1 shows a schematic representation of a cleaning plant having a cleaning chamber and a transport device, FIG. 2 shows a variant of the sealing arrangement of the chamber opening, FIG. 3 shows the cleaning plant according to FIG. 1 in which the transport device is found above a shelf, FIG. 4 shows the cleaning plant according to FIG. 1 in a lateral view, FIG. 5 shows a second embodiment of the cleaning plant with an industrial robot as a transport device in the position of taking up the items to be cleaned, FIG. 6 shows the embodiment according to FIG. 1* in the position of delivering the items to be cleaned into the cleaning chamber,

*sic; FIG. 5—Translator's note

Figure 7:
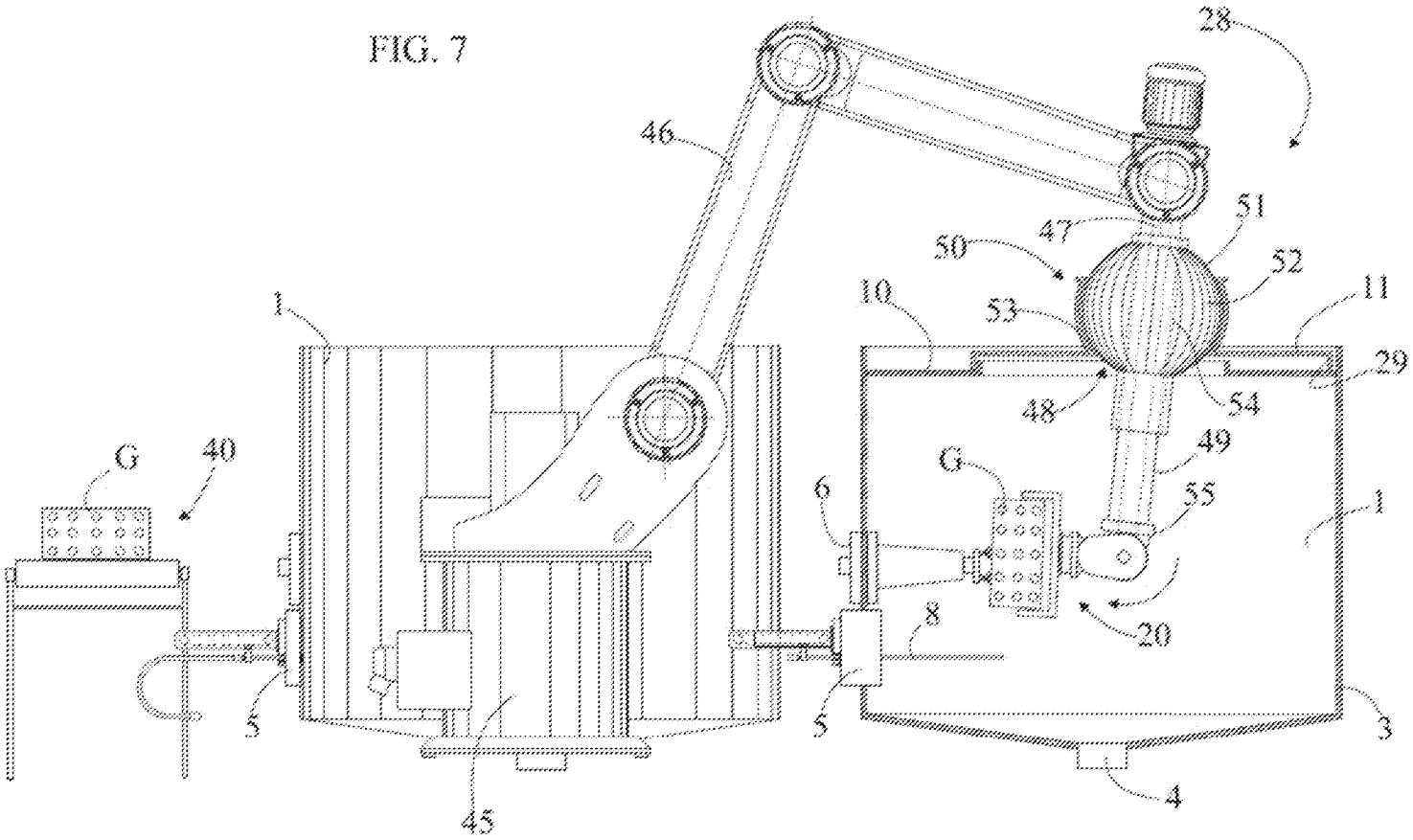
Figure 8:
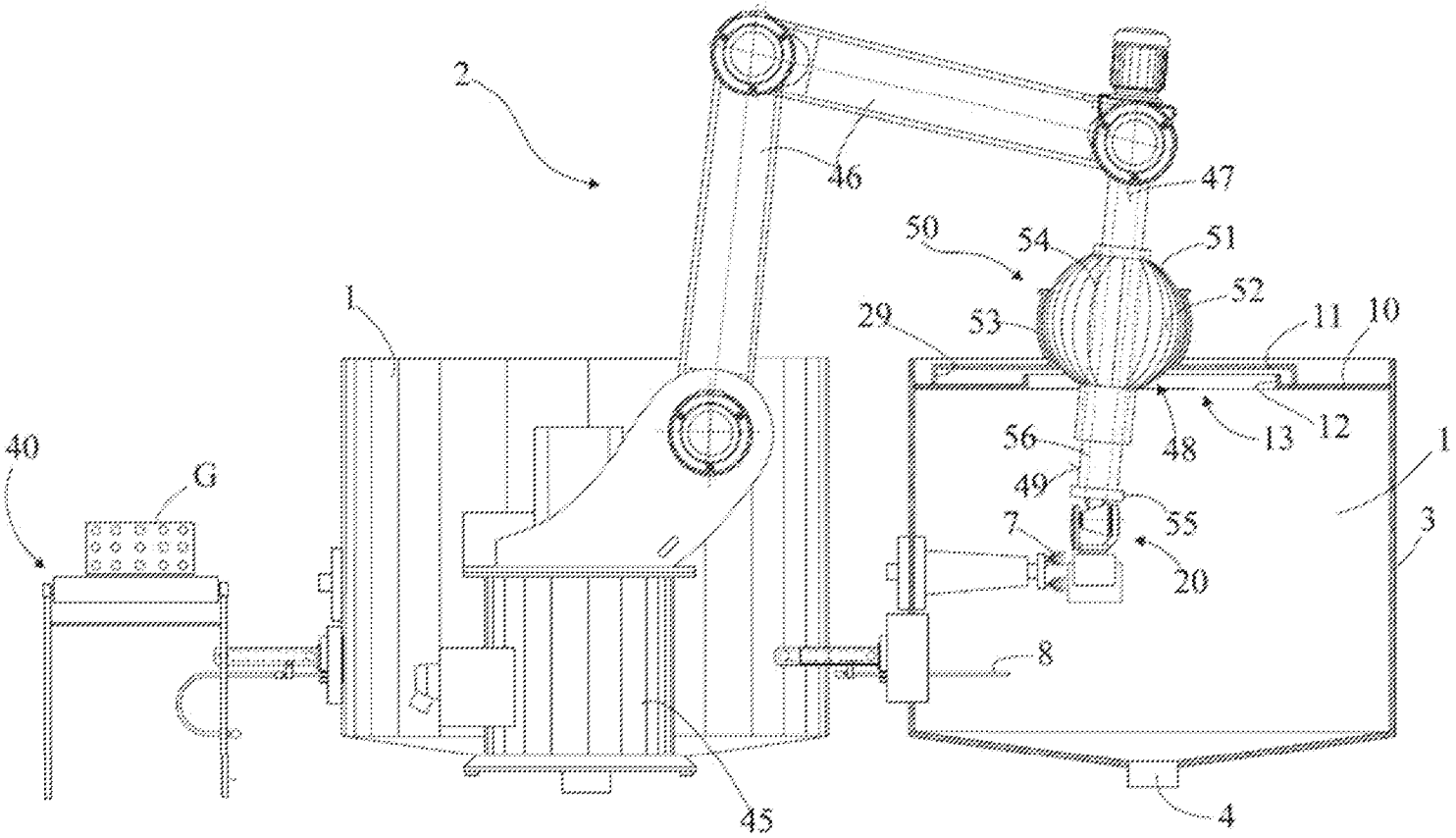
Figure 10:
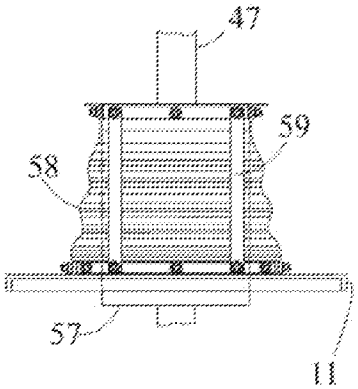
Figure 9:
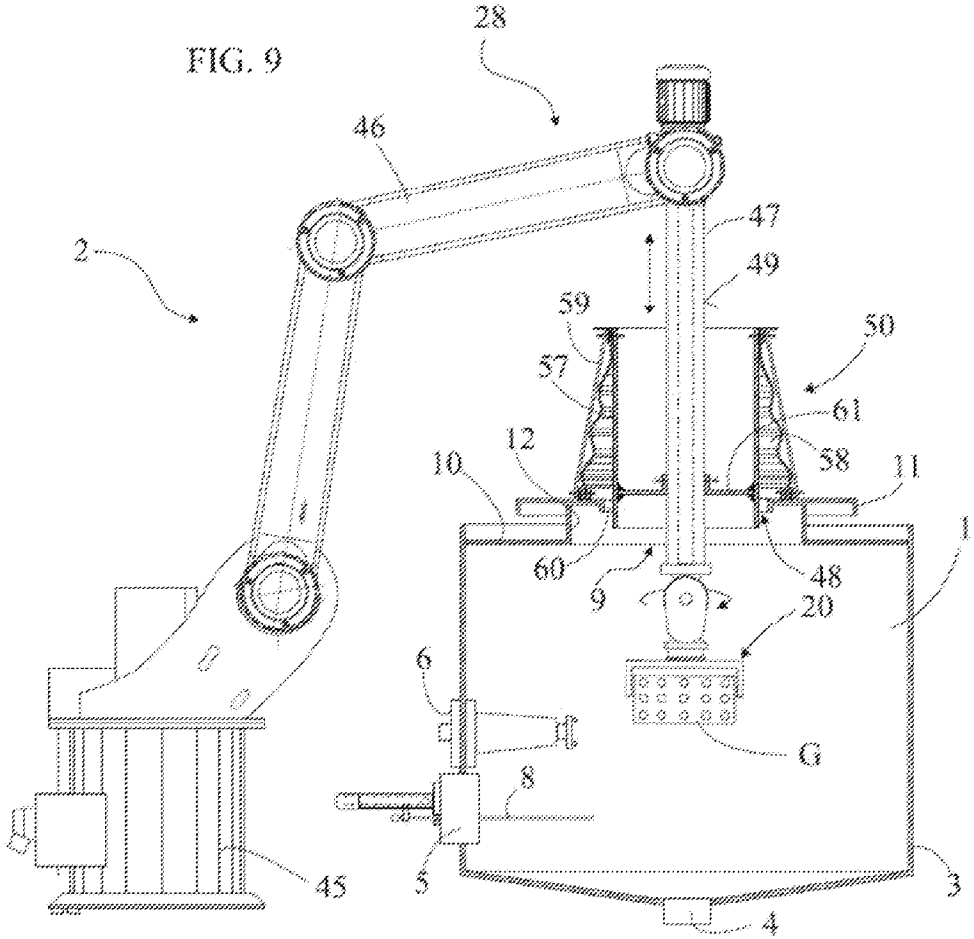
Figure 11:
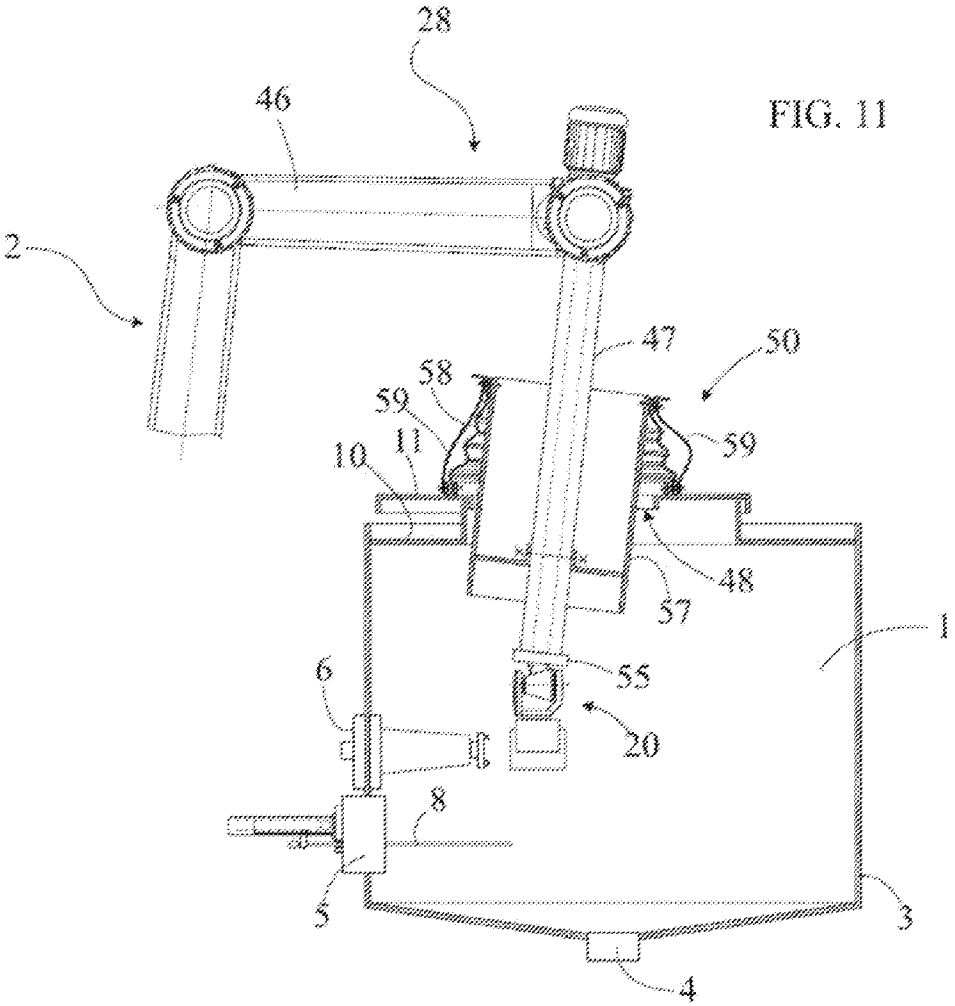

FIG. 7 shows the embodiment according to FIG. 5 and FIG. 6 in the operating position for the items to be cleaned in the cleaning chamber, FIG. 8 shows the embodiment according to FIG. 7 in another operating position for the items to be cleaned, FIG. 9 shows a variant of the cleaning plant according to FIGS. 5 to 8, FIG. 10 shows a detail of the plant according to FIG. 9, FIG. 11 shows another detail of the plant according to FIG. 9 in a self-aligning position of the lifting arm.

Two embodiments of the cleaning plant are described. A first embodiment is described in FIGS. 1 to 4 and a second embodiment is described in FIGS. 5 to 8. FIGS. 9 to 11 show a variant of the embodiment according to FIGS. 5 to 8. The same parts of the plant are provided with the same reference numbers, for which the respective parts of the description apply equally to both plants.

The cleaning plant is shown In FIGS. 1 to 4 with one cleaning chamber 1, and in FIGS. 4 to 8 with two cleaning chambers 1, which are loaded with a transport device 2. The cleaning chamber 1 is composed of a sheet-metal housing 3 with a lower drain 4 for used cleaning fluid. Mechanisms 5, 6 for emitting a treatment medium are introduced on the outer sheath of the cleaning chamber 1, these mechanisms projecting into the cleaning chamber 1, in one case with rotating sprinkling, spraying or emitting nozzles 7, and in the other case, with a lance 8 for high-pressure spraying. Lying opposite drain 4, the cleaning chamber 1 possesses a central opening 9 in the upper front wall 10 of the sheet-metal housing 3, which can be closed with a cover 11. In the example of embodiment, a central opening 9 is present. The opening 9 is designed in circular shape. Of course, cover 11 and opening 9 can also be square or rectangular. The edge of the opening 9 possesses an encircling collar web 12 placed outwardly. The cover 11 possesses a central aperture 13, which takes up the shaft 14 of the lifting arm 15. FIG. 1, FIG. 2 and FIG. 3 show a guide 18 for purposes of forming a slideable, telescopic sealing arrangement. The cover 11 has a collar-like cylindrical extension 19 on its inner side, and the lifting arm 15 is equipped with a cylindrical collar 21 on its end assigned to the gripping tool 20. Extension 19 and collar 21 are placed to slide inside one another telescopically. The collar 21 is attached by a bottom 22 to the front side of the lifting arm 15 and possesses a flange that acts as an entrainment mechanism 23. When the lifting arm 15 is raised, the entrainment mechanism 23 comes into effective connection with the cover 11 starting from a specific lifting height and is raised. In the reverse case, the cover 11 is set on the front wall 10 or an intermediate cover 24, starting from a specific lowering depth. The cover 11 is held in a guide 16 according to FIG. 4. The guide 16 has a bush 17 around the edge region of the aperture 13, in which the cover 11 is mounted slideable along the shaft 14**.

sic; 5**?—Translator's note.

As can be recognized best from FIG. 2, a loose intermediate cover 24 with a central opening 25 lies on front wall 10. The diameter of the central opening 25 can correspond to the diameter of the opening 9 in the front wall 10 or can be slightly smaller. The diameter of the intermediate cover 24 is essentially larger than the diameter of the opening 9 in the front wall 10 and possesses an outer encircling collar 26, by which the intermediate cover 24 lies on the front wall 10. The intermediate cover 24 is provided with an outwardly directed web 27 around the central opening 25. The difference in the diameter between the intermediate cover 24 and the opening 9 results in a dimension "B" around which the intermediate cover 24 can move in any direction on the front wall 10. The sliding range of the intermediate cover 24 on the front wall 10 is limited by the collar web 12 and the collar 26. Collar web 12 and collar 26 operate as stops.

In FIG. 1, the lifting arm 15 of the lifting device 28 projects into the cleaning chamber 1. The gripping tool 20, with which the items to be cleaned "G" are held, is found at the end of the lifting arm 15. On its outer edge, the cover 11 possesses an encircling sealing web 29 and acts jointly with the intermediate cover 24 in such a way that the sealing web 29 can be inserted approximately flush with only a small gap into the web 27 of the intermediate cover 24 and when the lifting arm 15 is lowered through the opening 9, an effective connection is automatically produced by setting the sealing web 29 by its front surface on the intermediate cover 24. In the position of the lifting arm 15 shown in FIG. 1, the cover 11 entrains the intermediate cover 24 with a back-and-forth movement of the transport device 2 or of the lifting arm 15, whereby sealing web 29 and web 27 of the intermediate cover 24 serve as the entrainment mechanism. The effective movement path in the case of a back-and-forth movement can correspond approximately to the dimension "B" with a corresponding formation of the cover 11, as explained below. In the example of embodiment, all covers 11, 24 and openings 9, 25 are designed as circular.

In FIG. 2, a simplified variant of the sealing arrangement is shown. No intermediate cover 24 is present, so that the cover 11 lies directly by its sealing web 29 on the front wall 10, or the cover 11 is supported by its sealing web 29 on the collar web 12 of the front wall 10. It can be recognized that the lifting arm 15 is displaced from the center of the cleaning chamber 1 toward the left in the direction of the nozzles 7 with entrainment of the cover 11.

According to FIGS. 1, 2, 3 and 4, the lifting arm 15 is advantageously designed as a column disposed vertically in guides 30 and can be moved with a chain drive 31, by joining the upper end of the lifting arm 15 with a lock 32 with the drive chain 33. The drive chain 33 is guided between two pinions 34, 35, wherein one pinion 34 is driven by a motor 36. The chain drive 31 is attached to a console 37, which is accommodated on a trolley 38 or a carriage 41 mounted on the trolley 38. The trolley 38 moves on guide rails 39 and can transport the lifting arm 15 from a position above the shelf 40 for the items to be cleaned "G" to a position above the opening 9 of the cleaning chamber 1. A vertical movement is conducted by the lifting arm 15. With the gripping tool 20, the items to be cleaned "G" can be received by the shelf 40 and can be raised by the lifting arm 15 and lowered into the cleaning chamber 1. In the operating position of the lifting arm 15 within the cleaning chamber 1, a back-and-forth movement can be conducted with the trolley 38 or the carriage 41, so that the items to be cleaned "G" can be guided along to any desired place of the sprinkling, spraying or emitting nozzles 7, 8 during the treatment. The cover 11 makes these movements together with the intermediate cover 24 and closes the opening 9. The lifting arm 15 can also be controlled up and down in the vertical direction inside the cleaning chamber 1 and during the treatment, so that all places of the items to be washed "G" can be reached on one side. Advantageously, the lifting arm 15 with the gripping tool 20 can be mounted in a rotatable manner around its longitudinal axis, so that by rotating the gripping tool 20, cleaning can be conducted on all peripheral sides. Advantageously, a drive shaft 42 for the gripping tool 20, which is driven by a motor 43 accommodated at the other end of the lifting arm 15, is mounted throughout in the lifting arm 15.

In order to increase the flexibility of the transport device 2, the carriage 41 is installed on rails 44 of the trolley 38. The guide rails 39 can be placed along a series of cleaning chambers 1 up to the shelf 40. A circular arrangement is also conceivable, in which several cleaning chambers 1 are disposed in an arc and the shelf 40 is inserted between two adjacent cleaning chambers 1, so that soiled items to be washed "G" are removed from the shelf 40 and are introduced into a first cleaning chamber 1, in which a first treatment process, for example, a washing process takes place, up to a last cleaning chamber 1, in which, for example, a drying process takes place, and from there, the cleaned items "G" are brought to the shelf 40 for outward transport. If the carriage 41 is disposed crosswise to the running direction of the trolley 38, the lifting arm 15 with the gripping tool 20 can be moved independently from the running direction of the trolley 38. Due to this arrangement, irregularly disposed cleaning chambers 1 can also be operated at a distance from the shelf 40 in a 3-coordinate system. In the simplest case, cleaning chambers 1 disposed in a series and at a distance from a shelf 40 found distanced from the cleaning chambers 1, as the origin, for example, can be loaded with items to be washed "G" from a conveyor belt, whereby the lifting arm 15 with gripping tool 20 takes up the items to be cleaned "G" and raises them in a plane above the level of the cleaning chambers 1, the trolley 38 controls a first cleaning chamber 1 with an X coordinate, and the carriage 41 transports the lifting arm 15 with items to be cleaned "G" along a Y coordinate into a position above the opening 9 or 25 of the cleaning chamber 1. The lifting arm 15 finally lowers the gripping tool 20 with the items to be cleaned "G" through the openings 25, 9 and holds them during the treatment, whereby in this position, carriage 41, trolley 32* and lifting arm 15 execute movements, also washing movements, coordinated relative to one another.

*sic; trolley 38?—Translator's note.

It should be mentioned that the position of the transport device 2 is shown in the operating position of the cleaning chamber 1 in FIG. 1, while the transport device 2 is shown in a position for placing the goods to be washed "G" on the shelf 40 in FIG. 3. It can be seen that cover 11 and lifting arm 15 remain connected. In FIG. 4, the lateral view of the cleaning plant is shown, in which a transport movement of the lifting arm 15 is produced with the carriage 41 crosswise to the direction of movement of trolley 38.

The cleaning plant according to FIGS. 5 to 8 and 9 to 11 contains, as transport device 2, an industrial robot 45 with a manipulator arm 46 that can be controlled about several axes and a lifting arm 47, with a gripping tool 20 on the free end. The cover 11 is guided in moveable manner in the central aperture 48 along the shaft 49 of the lifting arm 47. A connection in the form of a self-aligning bearing 50 exists between cover 11 and lifting arm 47, so that the freely suspended cover 11 can swing freely. The self-aligning bearing 50 is designed according to FIGS. 5 to 8 as a ball-and-socket joint 51 with a ball head 52 and a ball socket 53. The ball head 52 is mounted moveably in a guide on the shaft 49 of the lifting arm 47, and the ball socket 53 is found on the cover 11 in the edge region of the aperture 48. The entrainment mechanism 55 at the end of the lifting arm 47 forms a stop for the entrainment of the cover 11 in the upward movement of the lifting arm 47. For closing the cover 11 in the aligned position with the cleaning chamber 1 in the downward movement of the lifting arm 47, the cover 11 is placed on the cleaning chamber 1. In the operating position, the gripping tool 20 with the lifting arm 47 can be moved up and down in the guide 54 or can be moved in the self-aligning bearing 50 in a self-aligning movement with the manipulator arm 46. Another possibility for executing a movement consists of the fact that the cover 11 can be moved by its support surface in the edge region of the opening 9, so that a back-and-forth movement of the gripping tool 20 can be conducted. An optimal adjustment and alignment of the items to be cleaned G on several sides in the cleaning chamber is made possible thereby. Further, a rotation of the gripping tool 20 and a pivoting are possible by means of a shaft 56 in the lifting arm 47, as shown in FIG. 7*. FIG. 7 further shows that the cover 11 is displaced to the right edge of the cleaning chamber 1. FIG. 8 shows the position of the cover 11 displaced to the left edge of the cleaning chamber 1.

*sic; FIG. 6?—Translator's note.

The cleaning plant according to FIGS. 9 to 11 shows a variant of the plant according to FIGS. 5 to 8. The essential difference consists of the special design of the self-aligning bearing 50. The other plant parts described in FIGS. 5 to 8 apply also correspondingly to the variant according to FIGS. 9 to 11, so that reference is made to the preceding descriptions. The self-aligning bearing 50 makes possible the mobility of the lifting arm 47 with its gripping tool 20 in the treatment chamber 1 in several directions without formation of a special rotating joint or hinge between cover 11 and lifting arm 47. The function of a self-aligning movement of the lifting arm 47 during the treatment in the cleaning chamber 1, i.e., with closed cover 11, is achieved by a guide unit 57 which is inserted with a gap 60 into the aperture 48 of the cover 11, this gap being large enough that the guide unit 57 can be inclined by a defined angle toward the horizontal, without producing thereby a forced jamming with the cover 11. On the other hand, the gap 60 shall be sufficiently small that a horizontal displacement of the cover 11 on the front wall 10 of the cleaning chamber 1 is made possible with a corresponding horizontal movement of the lifting arm 47. Further, the guide unit 57 shall have an elongated shape, so that guidance is produced in aperture 48 over the entire lifting path of the lifting arm 47.

The lifting arm 47 passes through the guide unit 57 and is tightly fastened to the shaft 47 of the lifting arm 47 via a connection 61. Lifting arm 47 and the guide unit form one structural unit with the connection 61. An open-side cage or cylinder with round or rectangular cross section can be used as the guide unit 57. For sealing the gap 61*, a flexible sealing unit 58 made of liquid-tight material, which is formed as a bellows or sleeve, is installed between the cover 11 and the guide unit 57 and is attached by one end to a flange (not shown in more detail) of the cover 11, and by the other end to the upper edge region of the guide unit 57. During the cleaning in the cleaning chamber 1, the sealing unit 58 is pressed together and pulled apart like an accordion by the movements of the lifting arm 47. For relieving the load on the sealing unit 58 during the transport process, the cover 11 is held by carrying straps 59 to the guide unit 57 or to the lifting arm 47**.

sic; shaft 49?—Translator's note. *sic; gap 60?—Translator's note.

| List of reference numbers |
|---|
| 1 Cleaning chamber |
| 2 Transport device |
| 3 Sheet-metal housing |
| 4 Drain |
| 5 Emitting means |
| 6 Emitting means |
| 7 Nozzles |
| 8 Lance |
| 9 Opening |
| 10 Front wall |
| 11 Cover |
| 12 Collar web |
| 13 Aperture in 11 |
| 14 Shaft |
| 15 Lifting arm |
| 16 Guide |
| 17 Bush |
| 18 Guide |
| 19 Extension |
| 20 Gripping tool |
| 21 Collar |
| 22 Bottom |
| 23 Entrainment mechanism |

-continued

| List of reference numbers |
|---|
| 24 Intermediate cover |
| 25 Opening of 24 |
| 26 Collar |
| 27 Web |
| 28 Lifting device |
| 29 Sealing web |
| 30 Guides of 15 |
| 31 Chain drive |
| 32 Lock |
| 33 Drive chain |
| 34 Pinion |
| 35 Pinion |
| 36 Motor |
| 37 Console |
| 38 Trolley |
| 39 Guide rails |
| 40 Shelf |
| 41 Carriage |
| 42 Drive shaft |
| 43 Motor of 15 |
| 44 Rails |
| 45 Robot |
| 46 Manipulator arm |
| 47 Lifting arm of 46 |
| 48 Central aperture |
| 49 Shaft of 47 |
| 50 Self-aligning bearing |
| 51 Ball-and-socket joint |
| 52 Ball head of 51 |
| 53 Ball socket of 51 |
| 54 Guide of 51 |
| 55 Entrainment mechanism for |
| 56 Shaft |
| 57 Guide unit |
| 58 Sealing unit |
| 59 Carrying strap |
| 60 Gap |
| 61 Connection |

The invention claimed is:

1. An industrial cleaning plant having at least one cleaning chamber and a transport device that can be driven, rotated or pivoted for loading or unloading the at least one cleaning chamber, whereby the transport device has a lifting device, with which a transport lift is produced into the at least one cleaning chamber and said lifting device has a lifting arm with a gripping tool for items to be cleaned "G", which gripping tool is guided through openings of the at least one cleaning chamber, wherein the openings of the at least one cleaning chamber can be closed by a cover, which forms one structural unit with the lifting device and which is placed in a downward movement of the lifting arm on the at least one cleaning chamber for closing it, wherein the cover is moveably in a guide in an aperture along the shaft of the lifting arm so that in the closed position of the cover, an up-or-down movement of the gripping tool within the at least one cleaning chamber can be controlled with the lifting arm, wherein the lifting arm has an entrainment mechanism, which forms a stop for the cover in an upward movement of the lifting arm for opening the at least one cleaning chamber.

2. An industrial cleaning plant having at least one cleaning chamber and a transport device that can be driven, rotated or pivoted for loading or unloading the at least one cleaning chamber, whereby the transport device has a lifting device, with which a transport lift is produced into the at least one cleaning chamber and said lifting device has a manipulator arm controllable about axes and a lifting arm with a gripping tool for items to be cleaned, which gripping tool is guided through openings of the at least one cleaning chamber, wherein the openings of the at least one cleaning chamber can be closed by a cover, which forms one structural unit with the lifting device and which is placed in a downward movement of the lifting arm on the at least one cleaning chamber for closing it, wherein the cover is moveably in a guide in an aperture along the shaft of the lifting arm, and wherein a connection is produced between the cover and the lifting arm via a self-aligning bearing, which has a guide for the uptake of the lifting arm so that within the closed cleaning chamber a translatory movement of the lifting arm in the guide or a self-aligning movement of the lifting arm in the self-aligning bearing are controllable with the manipulator arm, and wherein an entrainment mechanism is provided, which forms a stop for the cover in an upward movement of the lifting arm for opening the at least one cleaning chamber.

3. The industrial cleaning plant according to claim 2, further characterized in that the transport device is an industrial robot.

4. The industrial cleaning plant according to claim 2, further characterized in that for the self-aligning bearing on the shaft of the lifting arm, a guide unit is fastened, which is inserted in the aperture of the cover with a gap, and a flexible sealing unit, such as a sheath or sleeve, surrounding the guide unit is provided, which is fastened on one side to the cover and on the other side to the guide unit or the lifting arm.

5. The industrial cleaning plant according to claim 2, further characterized in that the cover is held in the aperture along the guide unit.

6. The industrial cleaning plant according to claim 2, further characterized in that the cover is held with carrying straps to the guide unit.

7. The industrial cleaning plant according to claim 3, further characterized in that the sealing unit is composed of a liquid-tight material.

8. The industrial cleaning plant according to claim 2, further characterized in that the self-aligning bearing is designed as a ball-and-socket joint with a ball head on the lifting arm and a ball socket on the cover.

9. The industrial cleaning plant according to claim 8, further characterized in that the ball socket is formed around the central aperture.

10. The industrial cleaning plant according to claim 1, further characterized in that the diameter of the opening is smaller than the diameter of the cover, and in that the closed cover with the lifting arm is formed moveable on a front wall of the at least one cleaning chamber.

11. The industrial cleaning plant according to claim 1, further characterized in that the guide has telescoping or inter-engaging regions from cover and lifting arm.

12. The industrial cleaning plant according to claim 11, further characterized in that in the guide, for purposes of forming a telescoping sealing arrangement, the cover has a collar-like cylindrical extension on its inner side, and the lifting arm, on its end assigned to the gripping tool, is equipped with a cylindrical collar, which engage in one another in sliding manner.

13. The industrial cleaning plant according to claim 1, further characterized in that the cover, by its support surface, and the support surface in the edge region of the opening of the at least one cleaning chamber form an interacting sealing arrangement moveable crosswise to one another.

14. The industrial cleaning plant according to claim 1, further characterized in that the cover is supported on a front wall of the at least one cleaning chamber by a surrounding sealing web in the edge region of the opening.

15. The industrial cleaning plant according to claim 1, further characterized in that on a front wall of the at least one cleaning chamber, an intermediate cover that is moveable on the surface of the edge region of the opening is disposed in the edge region of the opening, this cover being coupled with the cover in the direction of movement in the operating position of the lifting arm in the at least one cleaning chamber.

16. The industrial cleaning plant according to claim 15, further characterized in that the intermediate cover, on it inner edge, has an encircling web directed toward the cover, and, on its outer edge, an encircling collar directed toward the front wall.

17. The industrial cleaning plant according to claim 1, further characterized in that the edge of the opening is formed as an encircling collar web.

18. The industrial cleaning plant according to claim 1, further characterized in that the transport device has a trolley guided along between the shelf and the at least one cleaning chamber.

19. The industrial cleaning plant according to claim 18, further characterized in that a rail running crosswise to the direction of travel for a carriage that takes up the lifting arm is installed on the trolley.

20. The industrial cleaning plant according to claim 1, further characterized in that the lifting arm is executed as a column mounted in guides, this column having a continuous drive shaft in the longitudinal direction for the gripping tool.

21. The industrial cleaning plant according to claim 1, further characterized in that at its upper end, the lifting arm is fastened with a lock to a chain drive guided between an upper pinion and a lower pinion, this chain drive being installed on a console of the trolley.

* * * * *